US008317428B2

(12) United States Patent
Liberg et al.

(10) Patent No.: US 8,317,428 B2
(45) Date of Patent: Nov. 27, 2012

(54) DRAIN PIPE

(75) Inventors: Lars-Olof Liberg, Strömstad (SE); Bo Sundquist, Hisings Backa (SE)

(73) Assignee: GVA Consultants AB, Ostra Hamngatan, Gothenburg (SE)

( * ) Notice: Subject to any disclaimer, the term of this patent is extended or adjusted under 35 U.S.C. 154(b) by 275 days.

(21) Appl. No.: 12/582,170

(22) Filed: Oct. 20, 2009

(65) Prior Publication Data

US 2010/0098490 A1 Apr. 22, 2010

Related U.S. Application Data

(60) Provisional application No. 61/107,100, filed on Oct. 21, 2008.

(51) Int. Cl.
*B63B 13/00* (2006.01)

(52) U.S. Cl. ..... 405/195.1; 210/170.11

(58) Field of Classification Search ..... 405/195.1; 210/691, 170.11

See application file for complete search history.

(56) References Cited

U.S. PATENT DOCUMENTS

| | | | | |
|---|---|---|---|---|
| 2,077,044 | A | 4/1937 | Grace et al. | |
| 3,064,829 | A | 11/1962 | Winfrey et al. | |
| 5,114,273 | A | 5/1992 | Anderson | |
| 6,398,951 | B1 | 6/2002 | Smith et al. | |
| 2003/0044239 | A1 * | 3/2003 | Finn et al. | 405/224 |

FOREIGN PATENT DOCUMENTS

| | | |
|---|---|---|
| CN | 1630207 | 4/2005 |
| CN | 2784461 | 5/2006 |
| CN | 201058989 | 5/2008 |

* cited by examiner

*Primary Examiner* — David Bagnell
*Assistant Examiner* — Benjamin Fiorello
(74) *Attorney, Agent, or Firm* — KBR IP Legal Dept.

(57) ABSTRACT

A marine structure comprising a supporting member that comprises a wall at least partially delimiting said supporting member such that an inner side of said wall is arranged to at least partially delimit an inner volume of said supporting member and an outer side of said wall is arranged to face the ambient environment of said supporting member. The marine structure further comprises a drain pipe adapted to guide fluid from said marine structure to a body of water at least partially surrounding said marine structure. At least a portion of said outer side of said wall partially delimits said drain pipe.

15 Claims, 6 Drawing Sheets

DRAIN PIPE

CROSS-REFERENCE TO RELATED APPLICATIONS

This application claims priority to Provisional Patent Application No. 61/107,100 which was filed on Oct. 21, 2008, the entirety of which is incorporated by reference herein.

BACKGROUND

1. Field

The present embodiments generally relate to marine structures comprising a drain pipe adapted to guide fluid from the marine structure to a body of water at least partially surrounding the marine structure.

2. Description of the Related Art

It is conventional in oil and/or gas drilling and production to collect rainwater from the decks of a marine structure, such as a sea-going vessel or an offshore facility. Typically, a plurality of drains is arranged throughout one or more decks of the marine structure, especially on portions of the decks which are open and therefore exposed to the weather. Since the rainwater washes any spilled oil or grease off of the deck and into the drains, the collected rainwater may be passed through a filter or treatment facility in order to separate any oil or grease from the collected rainwater before it is guided to a body of water that at least partially surrounds the marine structure.

Drain pipes are used to guide the collected rainwater to the body of water that at least partially surrounds the marine structure in order to prevent people that are on, or in the vicinity of the marine structure from being hit or splashed by the fluid stream that is drained from the marine structure and/or to prevent objects, structures and/or apparatus on, or in the vicinity of the marine structure from being damaged by the fluid stream drained from the marine structure.

In addition, or instead, a drain pipe may be used for distributing additional fluids inter alia operational fluids—such as cooling water, ballast water or bilge water—from the marine structure to the body of water that at least partially surrounds the marine structure.

A drain pipe is normally fixedly attached to a supporting member of a marine structure, such as a support leg of an offshore facility for example, by a plurality of connecting means that are welded to the marine structure. Water waves, underwater currents and the wind can however exert substantial forces on the drain pipe and the marine structure, which may damage the marine structure and in the worst case, may cause the drain pipe to become detached from the marine structure

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
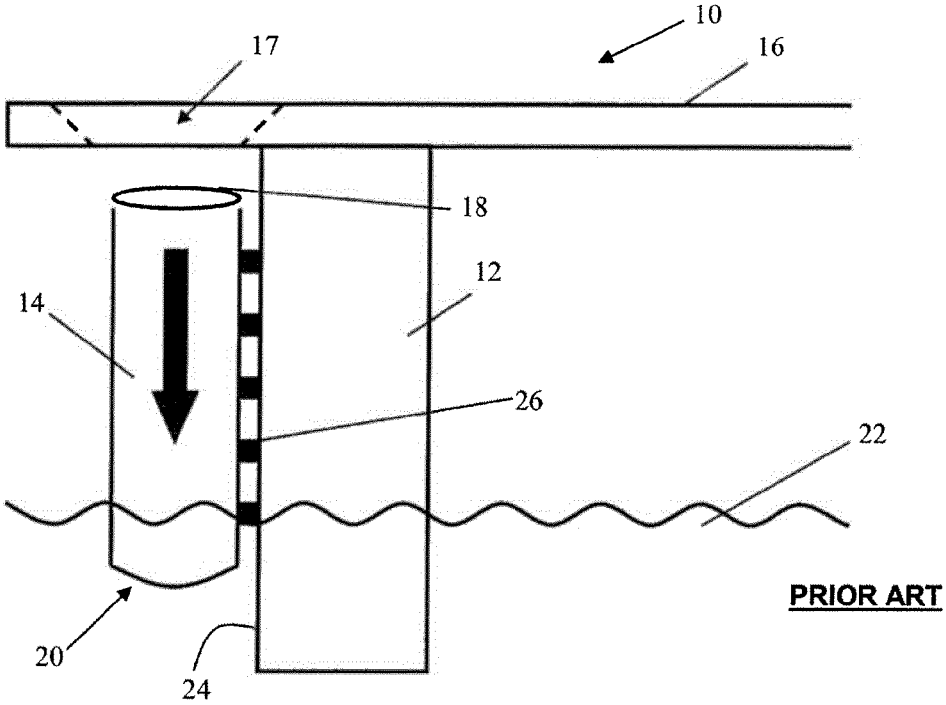
FIG. 1 depicts a side view of part of a marine structure according to the prior art.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

An object of the present invention is to provide an improved drainage system for a marine structure.

This object is achieved by a marine structure comprising a supporting member that comprises a wall at least partially delimiting the supporting member such that an inner side of the wall is arranged to at least partially delimit an inner volume of the supporting member and an outer side of the wall is arranged to face the ambient environment of the supporting member. The marine structure also comprises a drain pipe adapted to guide fluid along its inside from the marine structure to a body of water at least partially surrounding the marine structure. At least a portion of the outer side of the wall partially delimits the drain pipe, i.e. at least a portion of the outer side of the wall constitutes part of the periphery of the drain pipe.

Such a marine structure provides a robust drainage system that is simple to construct, repair and maintain.

The expression "to guide fluid" is intended to mean that fluid is arranged to flow along the inside of the drain pipe although the fluid is not necessarily in contact with the drain pipe as it is guided therethrough.

According to an embodiment of the invention the supporting member is arranged to be located at least partially in the body of water that at least partially surrounds the marine structure. The supporting member may however be located above the water level of the body water.

According to another embodiment of the invention the drain pipe comprises a fluid inlet and a fluid outlet, the fluid inlet being adapted to be located above the water level of the body of water that at least partly surrounds the marine structure and the fluid outlet being adapted to be located under the water level.

The drain pipe of a marine structure according to any of the embodiments of the invention may comprise a plurality of fluid inlets and/or a plurality of fluid outlets, whereby the expressions "the fluid inlet/outlet" as used in this document is intended to mean one of the plurality of fluid inlets/outlets in such a case.

According to a further embodiment of the invention the drain pipe further comprises an opening to the ambient environment located between the fluid inlet and the fluid outlet, in order to facilitate inspection of the drain pipe and to provide ventilation for any gas that may be drawn into or produced inside the drain pipe. Such an opening may extend all the way from the fluid inlet to the fluid outlet. The drain pipe may also or instead comprise a plurality of openings.

According to an embodiment of the invention the drain pipe further comprises a removable cover to prevent the flow of fluid into the drain pipe. Alternatively, the cover may comprise a filter means to prevent the flow of undesired material into the drain pipe.

According to another embodiment of the invention the drain pipe is constituted by one member plate only. The member plate may for example have a substantially C- or U-shaped cross section whereby one of the ends of the member plate is attached to the outer side of the wall of the supporting member.

A member plate may have a cross section of any shape and that a drain pipe according to any of the embodiments of the present invention need not necessarily have a uniform cross section along it entire length, i.e. uniform as regards its shape and/or area.

According to an alternative embodiment of the invention the drain pipe comprises at least two member plates, each of which is attached to the supporting member. The drain pipe may for example comprise only two member plates, each having a substantially C-, U- or L-shaped cross section.

According to a further embodiment of the invention the drain pipe comprises a third member plate having a substantially T- or +-shaped cross section.

A drain pipe according to the present invention may have a length of up to 50 m or more. A drain pipe may therefore comprise a plurality of member plates arranged longitudinally end to end with or without a gap therebetween. The specifications that the drain pipe comprises "one member plate only" or "only two member plates" is intended to mean not only that the whole drain pipe comprises only one or two member plates but also that the periphery of a drain pipe, when viewed in cross section, comprises one or two member plates only; the remainder of the periphery being made up by the outer side of the wall of the supporting member and optionally one or more openings.

According to an embodiment of the invention the drain pipe is attached to the supporting member by one or more weld joints, preferably continuous weld joints, which preferably extend substantially along the entire length of drain pipe.

According to another embodiment of the invention the marine structure further comprises a hoisting arrangement with a lift that is able to carry one or more human beings and/or repair/maintenance equipment/material. The lift is adapted to be raised and lowered within at least a portion of the drain pipe or along the outside of at least a portion of the drain pipe to facilitate mounting, maintenance and/or repair work. Preferably, the marine structure comprises guide means for guiding the lift in the drain pipe.

According to a further embodiment of the invention the marine structure is a semi-submersible unit comprising a deck structure and a float, wherein the supporting member is a support column extending between the deck structure and the float. According to an embodiment of the invention the float comprises an opening beneath the drain pipe such that a pump may be lowered therethrough.

According to another embodiment of the invention the drain pipe also comprises a housing that at least partially surrounds at least one pipe, such as a pipe connected to a pump, or some other part of the marine structure.

According to a further embodiment of the invention the drain pipe comprises at least one portion that extends substantially vertically when the drain pipe is mounted on the supporting member. Alternatively, the entire drain pipe is arranged to extend substantially vertically when it has been mounted on the supporting member.

According to an embodiment of the invention the drain pipe comprises an upper portion with an upper portion cross sectional area and a lower portion with a lower portion cross sectional area. The lower portion is adapted to be located between the upper portion and the body of water at least partially surrounding the marine structure. The lower portion cross sectional area is smaller than the upper portion cross sectional area to facilitate the flow of fluid into the drain pipe. As such, since the cross sectional area of the drain pipe is reduced as the drain pipe extends downwardly—i.e. towards the body of water—the flow rate in the drain pipe increases and the flow may be advantageously oriented in the drain pipe so as to obtain a maximum flow rate at or below the lower portion of the drain pipe. Moreover, the smaller still water portion cross sectional area may reduce the loads acting on the drain pipe as compared to a drain pipe with a uniform cross sectional area.

According to another embodiment of the invention the drain pipe comprises guiding means to guide fluid entering the drain pipe and/or fluid already flowing in the drain pipe towards said outer side of the wall of the supporting member.

According to a further embodiment of the invention the outer side of the wall forms at least two, preferably three, side walls for the drain pipe.

The marine structure according to the present invention may be an oil platform (also called oil rig), a gas platform, a drilling platform, seabed mining apparatus, a marine biology laboratory, power plant, a crane platform, sea-going vessel or any other structure located in a body of water, such as a sea, ocean, lake or river, or adjacent thereto.

With reference to the figures, FIG. 1 shows a part of a marine structure 10 according to the prior art. The marine structure comprises a supporting member 12 that is located at least partially in a body of water 22 and a drain pipe 14 that is arranged to drain fluid from a deck structure 16 which for example holds the necessary equipment used for either a drilling operation or the processing of crude oil and gas. Fluid (i.e. liquid or gas) collected, used or produced on the marine structure 10 enters a drainage channel 17, such as a scupper, in the deck 14 which guides the fluid into a fluid inlet 18 of the drain pipe 14. The fluid exits the drain pipe 14 via a fluid outlet 20 that is located below the water level of the body of water 22 that surrounds the marine structure 10. The drain pipe 14 is attached to the outer wall 24 of the supporting member 12 by connecting means 26 arranged along the length of the drain pipe.

Figure 2:
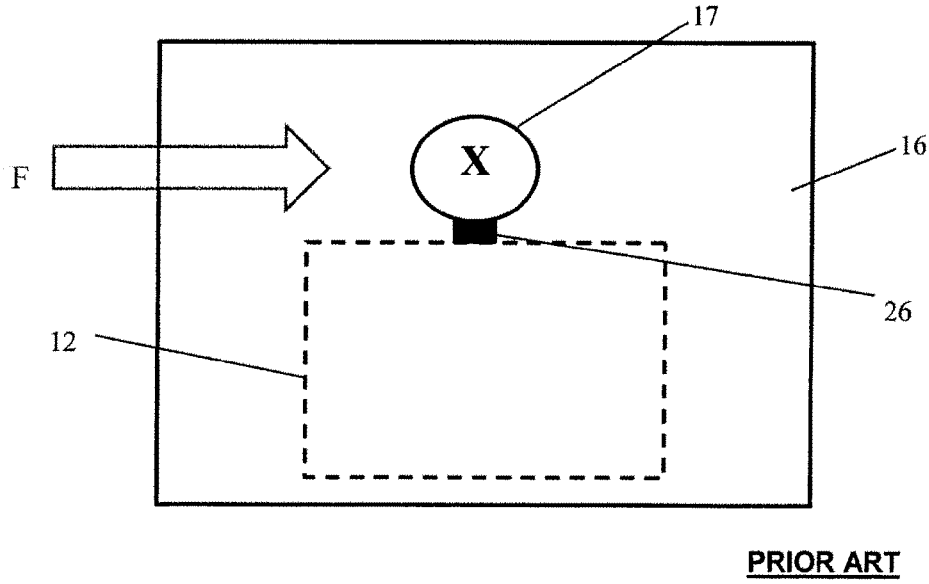
FIG. 2 depicts an overhead view of a deck of the marine structure shown in FIG. 1.

FIG. 2 shows the part of the marine structure 10 shown in FIG. 1 from above. The drain pipe 14, connecting means 26 and supporting member 12 are subjected to impact and drag forces from waves, underwater current and the wind, which forces are represented by the block arrow in FIG. 2, which forces may damage the marine structure 10. The block arrow in FIG. 2 represents the resultant force F on the drain pipe 14 at a given point in time. The drain pipe 14 may of course be subjected to forces acting in any direction.

Figure 3:
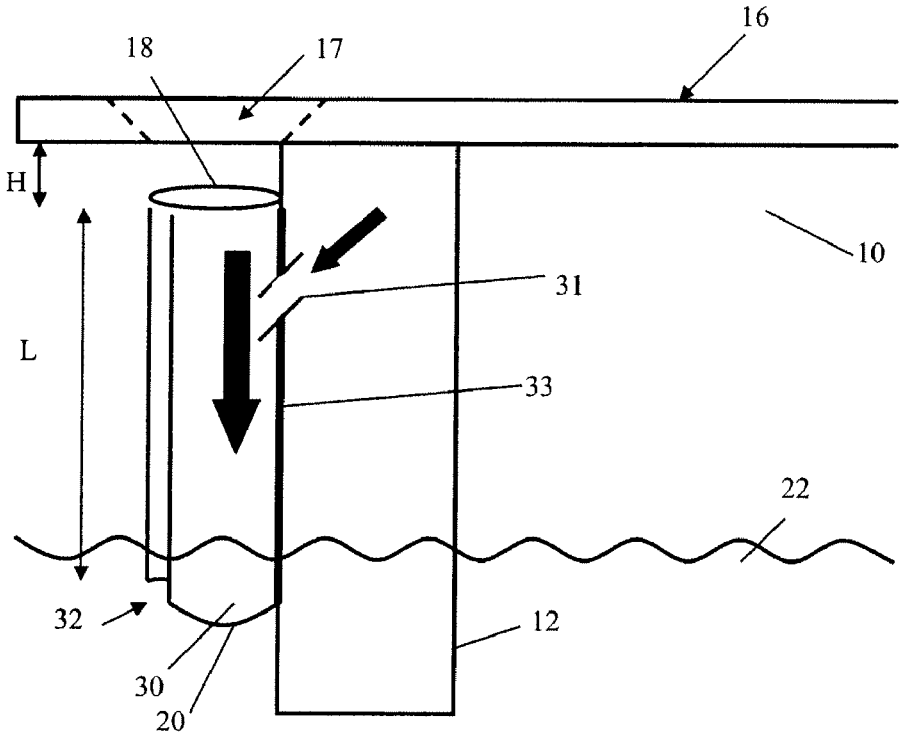
FIG. 3 depicts a side view of part of a marine structure according to an embodiment of the invention
Figure 4:
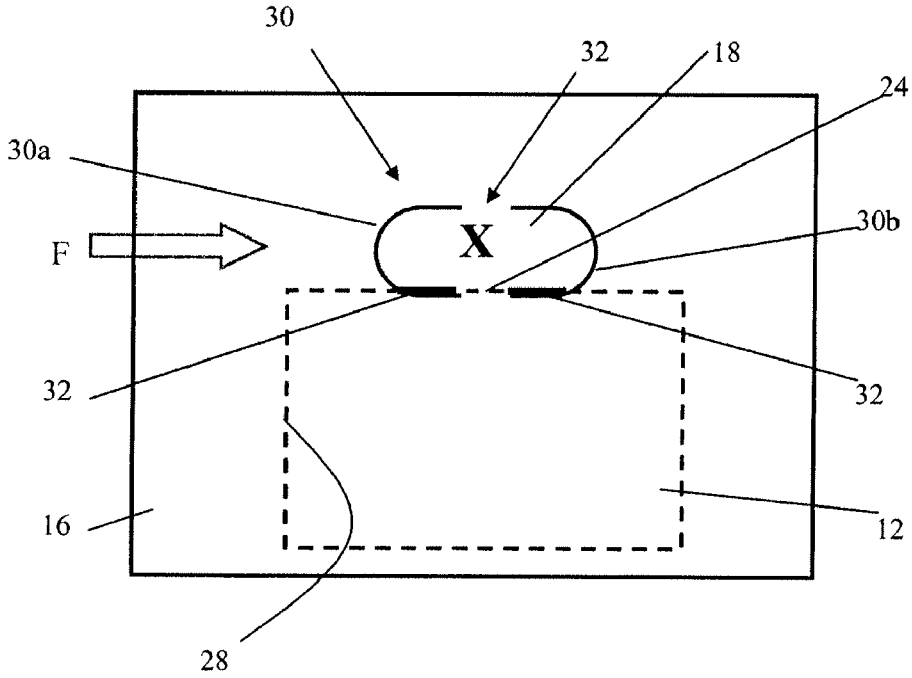
FIG. 4 depicts a top view of parts of marine structures according to embodiments of the invention.

FIGS. 3 and 4 show a marine structure 10 according to the present invention from the side and from above respectively. The marine structure 10 comprises a supporting member 12 that comprises a wall at least partially delimiting the supporting member such that an inner side 28 of the wall is arranged to at least partially delimit an inner volume of the supporting member 12. The inner volume of the supporting member 12 may be hollow or at least partially filled. An outer side 24 of the wall is arranged to face the ambient environment of the supporting member 12.

The marine structure 10 further comprises a drain pipe 30 adapted to guide fluid from the marine structure 10 to a body of water 22 at least partially surrounding the marine structure 10 and located directly below the fluid inlet 18 in the illustrated embodiment. The fluid inlet 18 of the drain pipe 30 is preferably located at a vertical distance H below the deck 16 so that any gases drawn into or produced in the drain pipe 30 may be vented to the atmosphere and not transported to the deck 16.

The fluid outlet 20 of the drain pipe 30 shown in FIGS. 3 and 4 is located below the water level of the body of water 22. The fluid outlet 20 may however be located at, or above the water level. The drain pipe 30 according to the invention may also comprise a plurality of fluid outlets 20 located above and below the water level as well as a plurality of water inlets 18. The drain pipe 30 may for example be arranged to receive fluid from a plurality of decks 16 of the marine structure 10. Purely by way of example, the drain pipe 30 may be adapted to receive fluid from an outlet 31, such as a ballast and/or a drain outlet, discharging from the supporting member 12 at a level below a deck 16 of the marine structure 10.

The drain pipe 30 according to any of the embodiments of the present invention may be adapted to receive fluid from any part of a marine structure 10, and not only from decks 16 of the marine structure.

At least a portion of the outer side 24 of the wall of the supporting member 12 partially delimits the drain pipe 30. The drain pipe's periphery (when viewed in cross section) is namely constituted by two plate members 30*a* and 30*b*, a portion of the outer side 24 of the wall of the supporting member 12 and an opening 32 that extends all the way from the fluid inlet 18 to the fluid outlet 20 of the drain pipe 30. Each of the two plate members 30*a* and 30*b* is attached to the supporting member 12 of the marine structure 10 by means of weld joints 33 that preferably extend substantially along the entire length L of the drain pipe 30. The drain pipe 30 or a drain pipe member plate may however be connected to a supporting member by any suitable means and in any suitable way.

Figure 5:
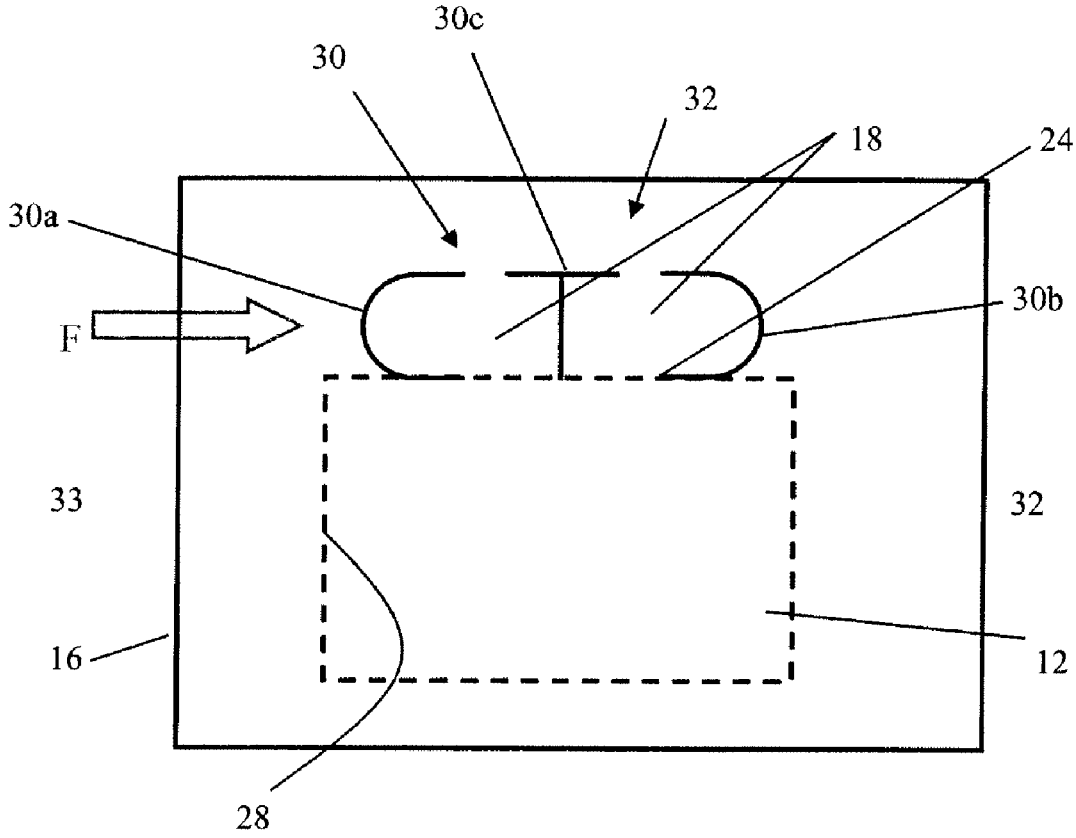
FIG. 5 depicts a top view of parts of marine structures according to embodiments of the invention.

FIG. 5 shows an alternative embodiment of the FIG. 4 marine structure 10 wherein the drain pipe 30 comprises a third member plate 30*c* having a substantially T-shaped cross section. As such, the FIG. 5 drain pipe 30 in fact comprises two conduits for distribution liquid from the marine structure 10 to the ambient water. In further embodiments of the marine structure 10, the drain pipe 30 may comprise a plurality of T-shaped plates or partitional plates of any other type (not shown) between the first 30*a* and the second 30*b* member plates such that three or more conduits (not shown) are formed. A plurality of conduits may be arranged to merge by providing the partitional plates with openings.

Figure 6:
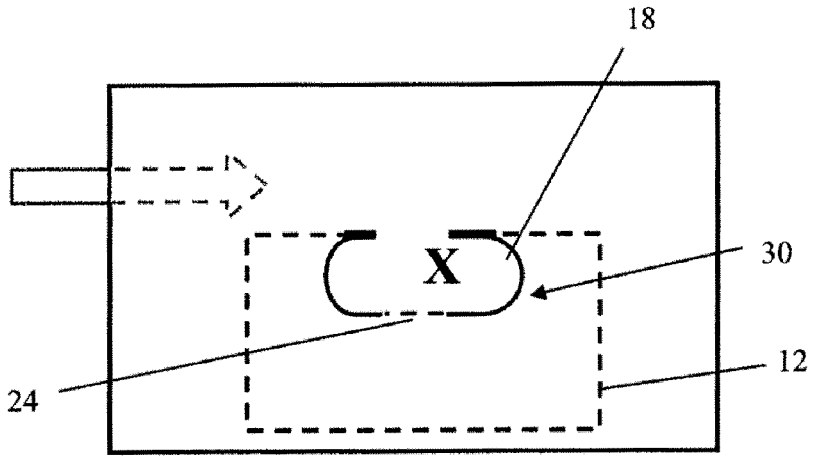
FIG. 6 depicts a top view of parts of marine structures according to embodiments of the invention.

FIG. 6 shows an alternative embodiment of the invention in which the drain pipe 30 is located entirely inside the supporting member 12 in a cavity that is partially delimited by the outer side 24 of the wall of the supporting member 12. In other words, the outer side 24 of the wall partially forms at least two, preferably three, side walls for the drain pipe 30. Such a structure will protect the drain pipe 30 from damage from waves, underwater currents and the wind and will decrease drainage system space requirements.

Figure 7:
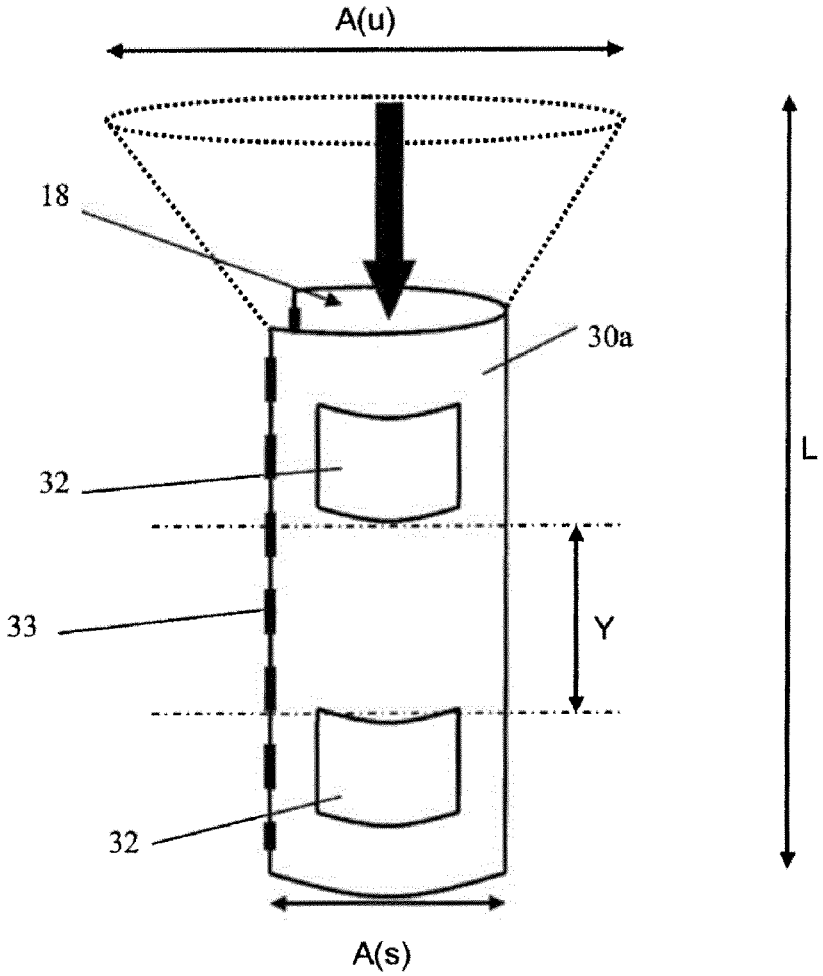
FIG. 7 depicts a drain pipe of a marine structure according to an embodiment of the invention.

FIG. 7 shows a drain pipe 30 according to an embodiment of the invention. The drain pipe 30 comprises one member plate 30*a* only. The member plate 30*a* has a substantially U-shaped cross section and comprises a plurality of openings 32. It is arranged to be fixedly attached to a supporting member 12 of a marine structure 10 so that the outer side 24 of the wall of the supporting member 12 constitutes the part of the periphery of the drain pipe 30 extending between the two ends of the U-shaped plate member 30*a*. The drain pipe 30 is arranged to extend substantially vertically when attached to the supporting member 12. The drain pipe 30 may however comprise one or more non-vertical sections.

The length L of the drain pipe 30 may range from 10 m to 100 m or more and may therefore comprise a plurality of member plates 30*a* such as the one shown in FIG. 7.

The drain pipe 30 according to the present invention may comprise a cover (not shown) to prevent water from entering the fluid inlet 18 of the drain pipe 30. The cover or a fluid inlet 18 may comprise a filter means or a grating in order to prevent objects from falling into the drain pipe 30.

The drain pipe according to any of the embodiments of the invention may comprise one or more filter means and/or treatment facilities located anywhere upstream or downstream of the drain pipe 30 or along the drain pipe 30. It should also be noted that the drain pipe may comprise means to guide at least part of the fluid flowing through the drain pipe 30 to another part of the marine structure 10, such as from apparatus on a higher deck of a marine structure to apparatus on a lower deck.

The drain pipe 30 according to the present invention may comprise a upper portion with a upper portion cross sectional area A(u) and a lower portion with a lower portion cross sectional area A(s), the lower portion cross sectional area A(s) being smaller than the upper portion cross sectional area A(u) as indicated by the dotted lines in FIG. 7. The lower portion is adapted to be located between the upper portion and the body of water 22 at least partially surrounding the marine structure 10. A drain pipe 30 may comprise such an upper portion only at the uppermost part of the drain pipe 30 by its fluid inlet, or if a drain pipe 30 comprises a plurality of drain pipe sections such as that shown in FIG. 7, a plurality of drain pipe sections may comprise such upper portions. Purely by way of example, if a drain pipe 30 only comprises one upper portion, the lower portion may be located at approximately one third of the length of the drain pipe 30 below the upper portion.

Preferably, the ratio of the upper portion cross sectional area A(u) and the lower portion cross sectional area A(s) (i.e. A(u)/A(s)) is within the range 1.5-4, more preferred within the range 1.8-2.5. Most preferred the aforesaid ratio is approximately 2.

The drain pipe 30 according to the present invention may comprise steel, plastic or any other suitable material and may include a physically and/or chemically reinforced section Y that is arranged to be located in an area that is subjected to greater forces than other parts of the drain pipe. A reinforced section Y may for example be arranged to be located in the splash zone (i.e. the area where waves of a sea, ocean, river or lake strike the drain pipe), which area may optionally be free of openings 32. The reinforced section Y may for example comprise a stronger metal grade or thicker metal and be coated with a rust or corrosion-resistant paint.

The marine structure 10 according to the present invention may comprise a hoisting arrangement (not shown) with a lift which lift is adapted to be raised and lowered within at least a portion of the drain pipe 30 or along the outside of at least a portion of the drain pipe 30. The drain pipe 30 of the present invention may namely have a diameter ranging from 1 to 5 m up to 15 m. Preferably, the marine structure 10 comprises guide means (not shown) for guiding the lift in the drain pipe 30. The hoisting arrangement may be detachable such that in may be placed in a storage location at a distance from the drain pipe 30 when the hoisting arrangement is not used.

Figure 8:
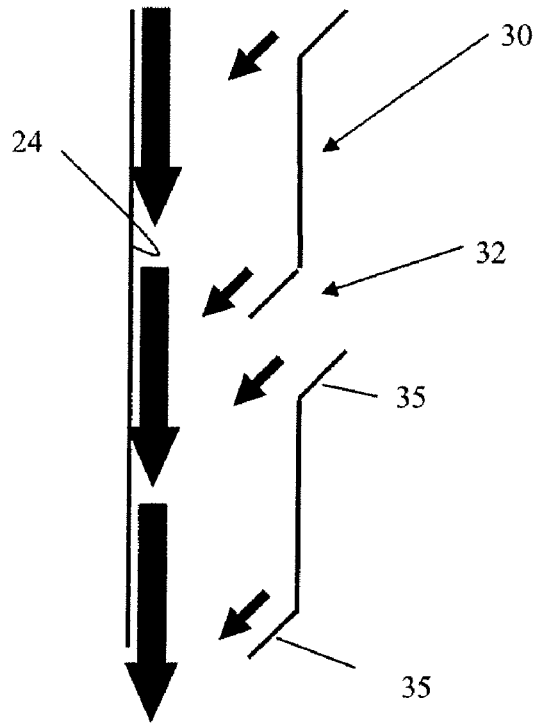
FIG. 8 depicts a drain pipe of a marine structure according to an embodiment of the invention.

FIG. 8 shows a drain pipe 30 according to an embodiment of the invention in which the drain pipe 30 comprises guiding means 35 to guide fluid towards the outer side 24 of the wall of the supporting member 12 which constitutes part of the periphery of the drain pipe 30. The guiding means 35 may for example comprise funnel means to ensure that fluid entering the drain pipe 30 and fluid that splashes away from the outer side 24 of the wall of the supporting member 12 as it flows through the drain pipe 30 is directed towards the outer side 24 of the wall of the supporting member 12. One or more openings 32 may be arranged at the side of the drain pipe 30 which is furthest from the outer side 24 of the wall of the supporting member 12 in order to facilitate inspection of the inside of the drain pipe 30 and to vent gases therefrom.

Figure 9:
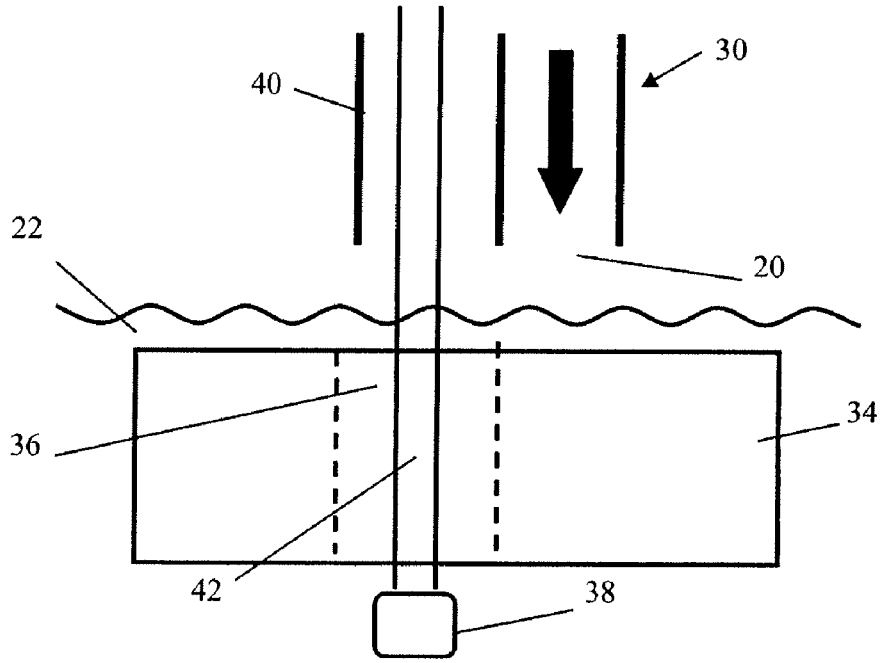
FIG. 9 depicts part of a marine structure according to an embodiment of the invention.
Figure 10:
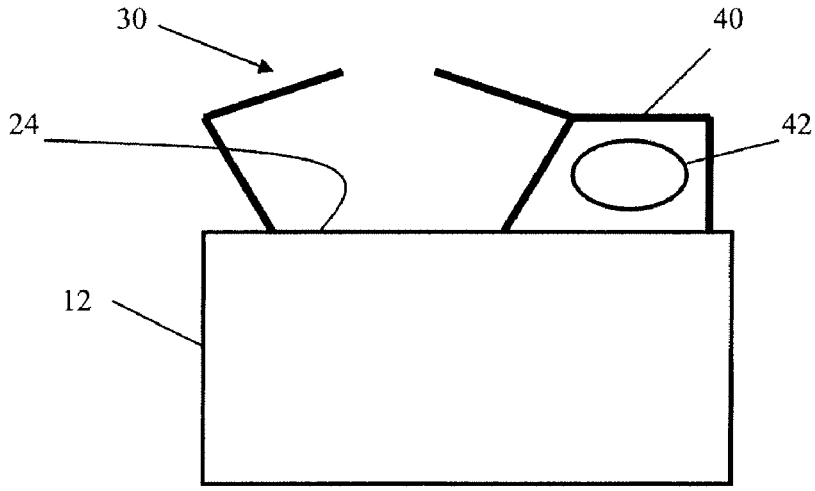
FIG. 10 depicts a drain pipe of a marine structure according to an embodiment of the invention.

FIG. 9 shows part of a semi-submersible marine structure a float 34 from the side, wherein the supporting member to which a drain pipe 30 is attached is a support column extending between a deck of the marine structure and the float 34. The float 34 may comprise an opening 36 beneath the drain pipe 30 such that a pump 38 may be lowered therethrough and into the water under the float 34 or surrounding the float 34. The drain pipe 30 shown in FIG. 9 comprises an integrally formed housing 40 that at least partially surrounds at least one pipe 42. Alternatively the housing 40 may be releasably or non-releasably connected to the drain pipe 30. FIG. 10 shows the drain pipe 30 and housing 40 from above. In the illustrated embodiment the housing 40 is attached to the supporting member 12.

The outer side 24 of the wall of the supporting member 12 has been shown as a flat surface in the illustrated embodiment. The outer side 24 of the wall of the supporting member 12 need not however be a flat surface.

When the drain pipe 30 is mounted on a support column, the ratio of the support column cross sectional area $A_C$ and the lower portion cross sectional area A(s) (i.e. $A_C/A(s)$) is preferably more than 10, more preferred more than 20.

Figure 11:
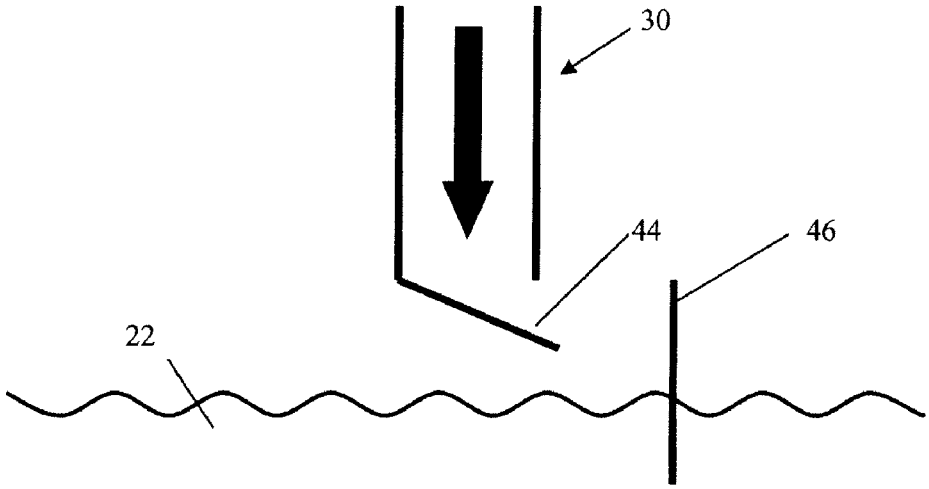
FIG. 11 depicts a drain pipe of a marine structure according to an embodiment of the invention.

FIG. 11 shows a fluid outlet of the drain pipe 30 according to an embodiment of the invention. The drain pipe 30 comprises a guide plate 44 that directs water exiting the drain pipe 30 at an angle. Since the fluid outlet of the drain pipe 30 in the illustrated embodiment is located above the water level the marine structure 10 may comprise a splash guard 46 to prevent people and/or other objects or part of the structure from being hit or splashed by the stream of fluid exiting the drain pipe 30. The splash guard 46 may be attached to a float 34 of a marine structure 10, a drain pipe 30 or any other part of a marine structure 10.

Further modifications of the invention within the scope of the claims would be apparent to a skilled person. For example, the supporting member 12 need not necessarily be vertical as shown in the illustrated embodiments. The drain pipe 30 according to the present invention could for example be connected to a float 34 and to a deck structure 16 of a marine structure 10.

Certain embodiments and features have been described using a set of numerical upper limits and a set of numerical lower limits. Ranges from any lower limit to any upper limit are contemplated unless otherwise indicated. Certain lower limits, upper limits and ranges appear in one or more claims below. All numerical values are "about" or "approximately" the indicated value, and take into account numerical error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A marine structure comprising a supporting member that comprises a wall at least partially delimiting said supporting member such that an inner side of said wall is arranged to at least partially delimit an inner volume of said supporting member and an outer side of said wall is arranged to face the ambient environment of said supporting member, said marine structure further comprising a drain pipe adapted to guide fluid from said marine structure to a body of water at least partially surrounding said marine structure, wherein at least a portion of said outer side of said wall partially delimits said drain pipe along a section in which said supporting member and said drain pipe are located in a parallel relationship such that said at least one portion of the outer side of said wall constitutes part of the periphery of the drain pipe along the section.

2. The marine structure according to claim 1, wherein said supporting member is arranged to be located at least partially in said body of water.

3. The marine structure according to claim 1, wherein said drain pipe comprises a fluid inlet and a fluid outlet, said fluid inlet being adapted to be located above the water level of said body of water and said fluid outlet being adapted to be located under said water level.

4. The marine structure according to claim 3, wherein said drain pipe further comprises an opening to the ambient environment located between said fluid inlet and said fluid outlet, in order to facilitate inspection of said drain pipe.

5. The marine structure according to claim 4, wherein said opening extends all the way from said fluid inlet to said fluid outlet.

6. The marine structure according to claim 1, wherein said drain pipe further comprises a cover.

7. The marine structure according to claim 1, wherein said drain pipe also comprises a housing that at least partially surrounds at least one pipe.

8. The marine structure according to claim 1, wherein said drain pipe comprises at least one section that extends substantially vertically when the drain pipe is mounted on said supporting member.

9. The marine structure according to claim 1, wherein said drain pipe comprises a upper portion with a upper portion cross sectional area and a lower portion with a lower portion cross sectional area, said lower portion being adapted to be located between said upper portion and said body of water at least partially surrounding said marine structure, said lower portion cross sectional area being smaller than said upper portion cross sectional area.

10. The marine structure according to claim 1, wherein said drain pipe comprises guiding means to guide fluid towards said outer side of the wall of the supporting member.

11. The marine structure according to claim 1, wherein said outer side of said wall forms at least two, preferably three, side walls for said drain pipe.

12. A marine structure comprising a supporting member that comprises a wall at least partially delimiting said supporting member such that an inner side of said wall is arranged to at least partially delimit an inner volume of said supporting member and an outer side of said wall is arranged to face the ambient environment of said supporting member, said marine structure further comprising a drain pipe adapted to guide fluid from said marine structure to a body of water at least partially surrounding said marine structure, characterized in that at least a portion of said outer side of said wall partially delimits said drain pipe, wherein said drain pipe comprises a fluid inlet and a fluid outlet, said fluid inlet being adapted to be located above the water level of said body of water and said fluid outlet being adapted to be located under said water level, and wherein said drain pipe further comprises an opening to the ambient environment located between said fluid inlet and said fluid outlet, in order to facilitate inspection of said drain pipe.

13. A marine structure comprising a supporting member that comprises a wall at least partially delimiting said supporting member such that an inner side of said wall is arranged to at least partially delimit an inner volume of said supporting member and an outer side of said wall is arranged to face the ambient environment of said supporting member, said marine structure further comprising a drain pipe adapted to guide fluid from said marine structure to a body of water at least partially surrounding said marine structure, characterized in that at least a portion of said outer side of said wall partially delimits said drain pipe, wherein said marine structure is a semi-submersible unit comprising a deck structure and a float, wherein said supporting member is a support column extending between said deck structure and said float and wherein said float comprises an opening beneath the drain pipe such that a pump may be lowered therethrough.

14. The marine structure according to claim 13, wherein said float comprises an opening beneath the drain pipe such that a pump may be lowered there through.

15. The marine structure according to claim 14, wherein said drain pipe also comprises a housing that at least partially surrounds at least one pipe, wherein said at least one pipe is connected to said pump.

* * * * *